US008212644B2

(12) United States Patent
Young et al.

(10) Patent No.: US 8,212,644 B2
(45) Date of Patent: Jul. 3, 2012

(54) TRANSFORMER ASSEMBLY

(75) Inventors: George Young, Dublin (IE); Brian Gaynor, Cork (IE); Andrew B. Keogh, Cork (IE)

(73) Assignee: Texas Instruments (Cork) Limited, Dublin (IE)

( * ) Notice: Subject to any disclaimer, the term of this patent is extended or adjusted under 35 U.S.C. 154(b) by 0 days.

(21) Appl. No.: 12/678,051

(22) PCT Filed: Sep. 12, 2008

(86) PCT No.: PCT/EP2008/062205

§ 371 (c)(1),
(2), (4) Date: Oct. 8, 2010

(87) PCT Pub. No.: WO2009/034179

PCT Pub. Date: Mar. 19, 2009

(65) Prior Publication Data

US 2011/0018676 A1 Jan. 27, 2011

(30) Foreign Application Priority Data

Sep. 12, 2007 (IE) ..... S2007/0647

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 5,319,342 | A * | 6/1994 | Kuroki | 336/170 |
| 7,414,507 | B2 * | 8/2008 | Giandalia et al. | 336/200 |
| 2003/0201863 | A1 * | 10/2003 | Chung | 336/200 |
| 2004/0145445 | A1 * | 7/2004 | Yang | 336/223 |
| 2007/0001796 | A1 * | 1/2007 | Waffenschmidt et al. | 336/223 |

* cited by examiner

*Primary Examiner* — Anh Mai
(74) *Attorney, Agent, or Firm* — William B. Kempler; Wade J. Brady, III; Frederick J. Telecky, Jr.

(57) ABSTRACT

The present invention relates to a transformer assembly (1) and a process for manufacturing same. The transformer (1) comprises a primary winding (5) wound on a PCB (9) and a secondary winding (7) mounted adjacent to the primary winding. The primary winding comprises a spiral coil, for example of wire or insulated wire, wound on the PCB. Gate drive windings (31, 33) are incorporated in the PCB (9) and there is therefore very close coupling between the primary winding and the gate drive windings. Furthermore, the secondary winding (7) is a center-tapped secondary having two halves. A flux balance winding (13) is provided to connect the two halves of the center-tapped secondary winding (7) and minimize leakage inductance thereby reducing power loss and spiking effects and obviating the need for complex control arrangements.

15 Claims, 4 Drawing Sheets

FIG. 3
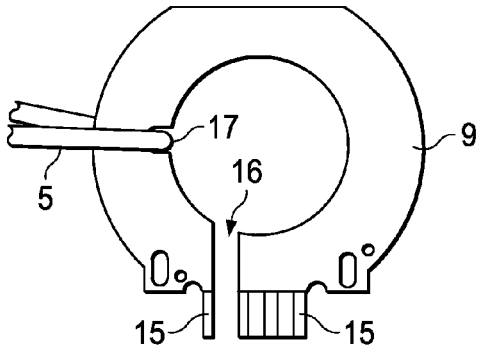
FIG. 4
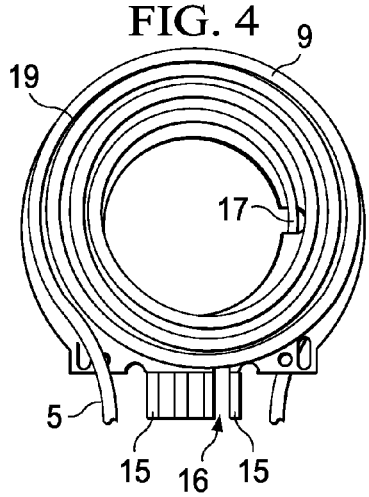
FIG. 5
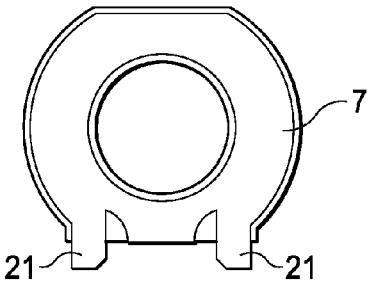
FIG. 7
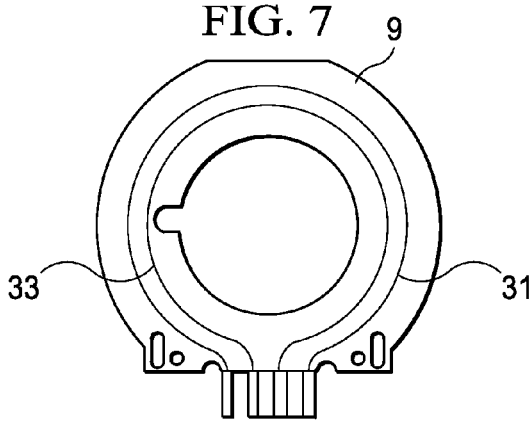
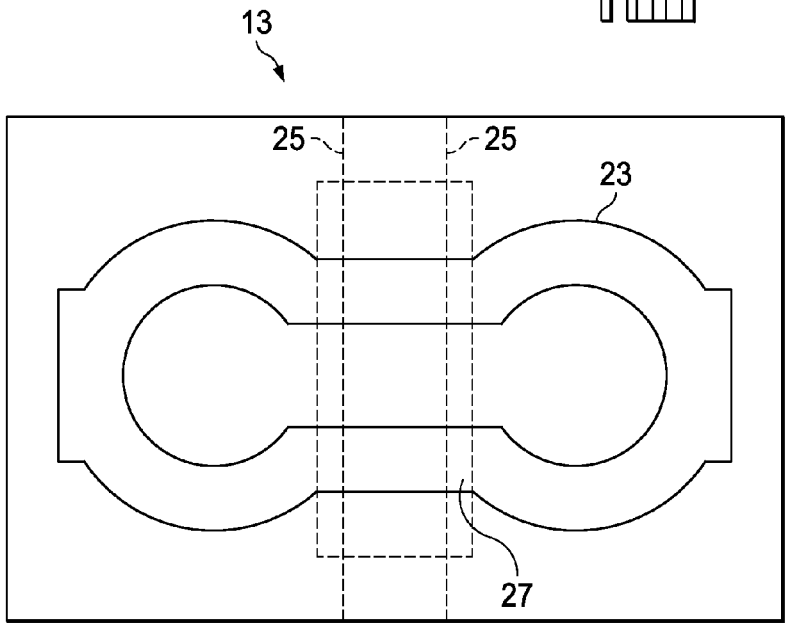
FIG. 6

TRANSFORMER ASSEMBLY

INTRODUCTION

This invention relates to a transformer assembly and more particularly to a transformer assembly comprising a magnetic core, a primary winding, a secondary winding and a printed circuit board.

Transformers are commonly used in a wide range of electronics applications including power conversion products. Depending on the particular application, there are several requirements that may be imposed on transformers. Generally speaking, transformers for power conversion products are ideally highly efficient, have low leakage inductance between the primary and the secondary windings, possess high voltage isolation corresponding at least to safety agency requirements, are compact with an acceptable form factor, provide quiet audio noise performance even with signals having an audio frequency component, provide excellent coupling between the two sides of a centre tapped winding and finally allow for simple provision of multiple wire requirements for gate drives, auxiliary supplies and the like.

It is an object of the present invention to provide a transformer that satisfies at least some of these requirements that is suitable in particular for power conversion products. It is further an object of the present invention to provide a transformer assembly that is relatively simple to construct and cost effective to manufacture.

STATEMENTS OF INVENTION

According to the invention there is provided a transformer assembly comprising a magnetic core, a primary winding and a secondary winding, characterised in that the primary winding further comprises a spiral winding of insulated wire, the spiral winding having a pair of connected spiral sections, the first spiral section winding inwardly and gradually decreasing in diameter to a connection branch with the second spiral section and the second spiral section winding outwardly and gradually increasing in diameter from the connection branch so that both ends of the winding are accessible at the periphery of the winding.

In one embodiment of the invention there is provided a transformer assembly in which there is provided a substrate upon which the primary winding is wound and each spiral section is wound on one side of the substrate.

In one embodiment of the invention there is provided a transformer assembly in which the substrate is a printed circuit board.

In one embodiment of the invention there is provided a transformer assembly in which the substrate is substantially horseshoe shaped with an open channel for through passage of a primary winding.

In one embodiment of the invention there is provided a transformer assembly in which the substrate is provided with a notch for placement of the winding of wire.

In one embodiment of the invention there is provided a transformer assembly in which the wire is wound flat against the substrate.

In one embodiment of the invention there is provided a transformer assembly in which the wire is wound in a single layer on each side of the substrate.

In one embodiment of the invention there is provided a transformer assembly in which the wire is insulated and is wound in a plurality of layers on each side of the substrate.

In one embodiment of the invention there is provided a transformer assembly in which there is provided a shield interposed between the primary winding and the secondary winding.

In one embodiment of the invention there is provided a transformer assembly in which the shield is a unitary shield substantially H-shaped having a cross bar and two pairs of legs projecting outwardly from the cross bar, the cross bar of the shield being positioned above the transformer adjacent the substrate and a pair of the legs of the shield protruding downwardly between the primary winding and the secondary winding on either side of the substrate.

In one embodiment of the invention there is provided a transformer assembly in which the transformer further comprises a gate drive turn implemented as a layer of a printed circuit board.

In one embodiment of the invention there is provided a transformer assembly in which the printed circuit board further comprises a plurality of interconnect fingers for connection of the printed circuit board to a main printed circuit board.

In one embodiment of the invention there is provided a transformer assembly in which the outer faces of the printed circuit board are implemented as shields.

In one embodiment of the invention there is provided a transformer assembly in which the outer faces of the printed circuit board implemented as shields are primary referenced for noise considerations.

In one embodiment of the invention there is provided a transformer assembly in which the outer faces of the printed circuit board implemented as shields are secondary referenced for safety voltage isolation considerations.

In one embodiment of the invention there is provided a transformer assembly in which there is provided a shield interposed between the primary winding and the secondary winding.

In one embodiment of the invention there is provided a transformer assembly in which the shield interposed between the primary winding and the secondary winding is connected to an outer face shield of the printed circuit board.

In one embodiment of the invention there is provided a transformer assembly in which the secondary winding is implemented using folded foil techniques.

In one embodiment of the invention there is provided a transformer assembly in which the secondary winding is provided with integral feet for connection of the secondary winding to a main PCB.

In one embodiment of the invention there is provided a transformer assembly in which the secondary winding is insulated.

In one embodiment of the invention there is provided a transformer assembly in which there is provided a Y-type capacitor.

In one embodiment of the invention there is provided a transformer assembly in which the secondary winding is a centre-tapped winding having a pair of winding halves.

In one embodiment of the invention there is provided a transformer assembly in which there is provided a flux balance winding.

In one embodiment of the invention there is provided a transformer assembly in which the flux balance winding is located intermediate the secondary winding and an adjacent magnetic core section.

In one embodiment of the invention there is provided a transformer assembly in which the flux balance winding is located intermediate the secondary winding and the primary winding.

In one embodiment of the invention there is provided a transformer assembly in which the flux balance winding is a unitary winding extending across the PCB and in which the flux balance winding is insulated around the area of the winding adjacent the PCB.

In one embodiment of the invention there is provided a transformer assembly in which the secondary winding is a centre tapped winding with a pair of winding halves and there is provided a pair of flux balance windings, each flux balance winding being mounted adjacent to a separate winding half of the centre-tapped secondary winding.

In one embodiment of the invention there is provided a transformer assembly in which the transformer is mounted on a main PCB and secured thereto about the transformer PCB.

In one embodiment of the invention there is provided a transformer assembly in which the transformer is mounted on a main PCB and secured thereto about leads formed integrally with the outer winding sections.

In one embodiment of the invention there is provided a transformer assembly in which the magnetic core is notched to provide passageways for wire connections.

In one embodiment of the invention there is provided a transformer assembly in which magnetic core further comprises a pair of E-cores mounted face to face with the arms of the E-cores opposing each other.

In one embodiment of the invention there is provided a transformer assembly in which the magnetic core further comprises an E-core and a planar core with the arms of the E-core facing the planar core.

In one embodiment of the invention there is provided a transformer assembly in which there are provided gaps in the core.

In one embodiment of the invention there is provided a transformer assembly in which there are provided gaps between the two or more adjacent windings.

In one embodiment of the invention there is provided a transformer assembly in which one or more of the windings are implemented using printed circuit board winding techniques.

In one embodiment of the invention there is provided a transformer assembly in which the printed circuit board windings have buried vias.

In one embodiment of the invention there is provided a transformer assembly in which the magnetic core is notched to allow egress of a winding.

In one embodiment of the invention there is provided a transformer assembly comprising a magnetic core, a primary winding, a centre tapped secondary winding having a pair of physically separated halves, the transformer further comprising a flux balance winding to reduce effective leakage inductance between the two halves of the centre tapped secondary.

In one embodiment of the invention there is provided a transformer assembly in which the flux balance winding is located intermediate the secondary winding and an adjacent magnetic core section.

In one embodiment of the invention there is provided a transformer assembly in which the flux balance winding is a unitary winding extending across the PCB and in which the flux balance winding is insulated around the area of the winding adjacent the PCB.

In one embodiment of the invention there is provided a transformer assembly in which there are provided a pair of separate flux balance windings, one of which is associated with one half of the centre tapped secondary winding and the other of which is associated with the other half of the centre tapped secondary winding.

In one embodiment of the invention there is provided a transformer assembly in which the printed circuit board windings have buried vias.

DETAILED DESCRIPTION OF THE INVENTION

The invention will now be more clearly understood from the following description of some embodiments thereof given by way of example only with reference to the accompanying drawings, in which:—

FIG. 3 is a front view of a printed circuit board forming part of the transformer assembly with the primary winding about to be wound on the printed circuit board;

FIG. 4 is a rear view of the printed circuit board forming part of the transformer assembly with the primary winding wound on the printed circuit board;

FIG. 5 is a front view of a secondary winding;

FIG. 6 is a diagrammatic representation of a flux balance winding for use in the transformer assembly according to the present invention;

FIG. 7 is a cross-sectional view of the printed circuit board showing the gate drive windings;

Figure 1:
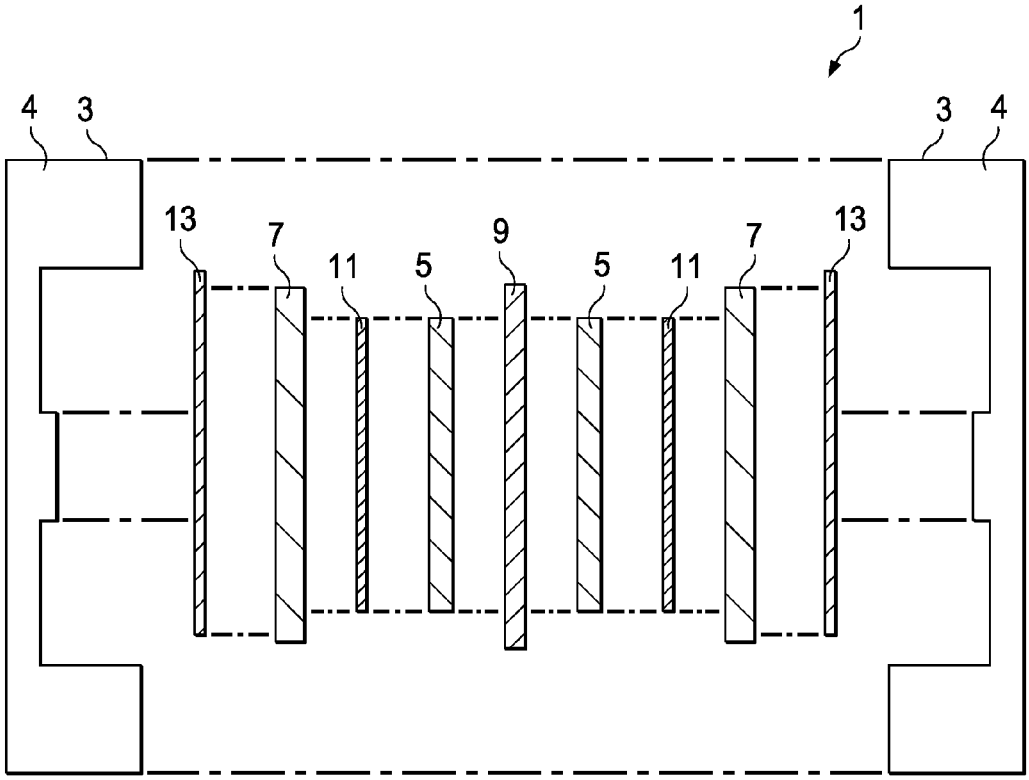
FIG. 1 is a cross-sectional exploded view of a transformer assembly according to the present invention.
Figure 2:
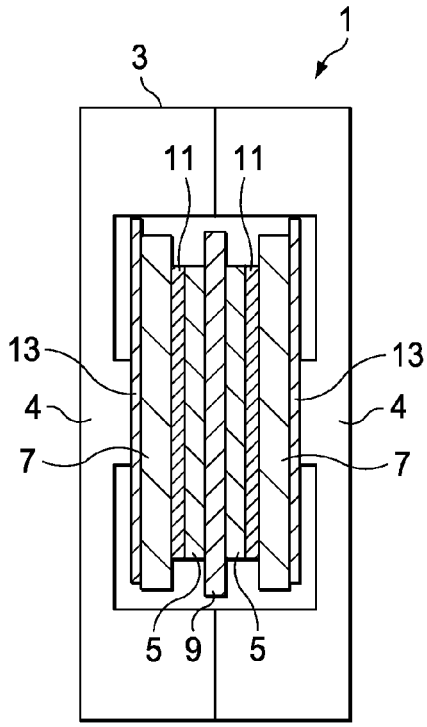
FIG. 2 is a cross-sectional view of the assembled transformer assembly according to the invention.

Referring to the drawings and initially to FIGS. 1 and 2 thereof, there are shown cross-sectional views of a transformer assembly, indicated generally by the reference numeral 1, comprising a magnetic core 3 which in turn comprises a pair of E-cores 4 arranged face to face, a primary winding 5, a secondary winding 7 and a printed circuit board 9. The transformer assembly 1 further comprises a shield 11 located intermediate the primary winding 5 and the secondary winding 7 and a flux balance winding 13 located intermediate the secondary winding 7 and the nearest E-core 4 to the secondary winding. The magnetic core 3 is a ferrite core which is gapped as needed, usually there will be a gap provided in the centre leg of the core. The transformer assembly further comprises gate drive turns (not shown) which are implemented as a section of the printed circuit board 9.

The outer faces of the printed circuit board 9 can be implemented as shields. In order to implement the outer faces as shields, the outer layers of PCB are dedicated for use as a shield and generally speaking will have a metal or foil coating substantially covering the entire surface area of the exterior so that they can operate as a shield. In this way, the shield can operate as an active balancing shield or as a passive grounded shield. The metal coating will in turn be provided with an insulating coating if it is to be in direct contact with a conducting material. The shield 11 is interposed between the primary winding 5 and the main secondary windings 7. The shield 11 is preferably an electrostatic shield made of a stamped copper foil and may be insulated if necessary. The optimum connection of this shield 11 is typically to the primary for signal purposes or the shield 11 is secondary-referenced for safety, and this can be connected to the shield integral to the printed circuit board 9 containing the gate drive windings. The shield 11 is typically a unitary winding of "H-shape" (or in other words a dual upturned "U" shape) where the centre-bar of the "H" is at the top of the transformer assembly 1 and the fingers of the "H" protrude down into the winding area to affect the shielding function. A Y-type capacitor can be used to effect the requirement that a shield is physically referenced for safety isolation to one side of the transformer and connected for signal purposes to the other side of the converter. Finally, a Y-type capacitor can be used to effect the necessary signal connection consistent with voltage isolation and is connected between primary and secondary quiet points.

Referring now to FIGS. 3 and 4, there is shown a pair of views of the printed circuit board 9 with the primary winding 5 attached thereto. The printed circuit board (PCB) 9 has a plurality of fingers 15 for connection of the gate drive turns (not shown) to corresponding connections on a main printed circuit board (not shown) as well as providing a stable mount for the transformer assembly on the main printed circuit board. The gate drive turns typically require one or two layers of the PCB 9. A notch 17 is provided in the gate drive printed circuit board 9 to facilitate the joining of the wire spirals on either side of the printed circuit board and mounting of the wire on the PCB 9. Referring specifically to FIG. 4, it can be seen that the primary winding 5 further comprises a spiral winding of pre-insulated wire 19 wound on the printed circuit board. The pre-insulated wire 19 is wound on both sides of the printed circuit board. Additional insulation (not shown), typically in the form of additional sleeving, may be provided if required to avoid the risk of chafing. It will be understood that fingers could be used to connect other components and not simply the drive windings of the PCB. There is additionally shown a gap 16 in the PCB. This Gap will allow for a pre-wound primary winding to be mounted on the PCB and is seen as particularly useful from a manufacturing complexity point of view.

By having the primary windings configured in such a manner, it is possible to provide a configuration that is often optimal, in that it is possible to have very close coupling between the gate drive turns and the primary winding 5, which is often advantageous in terms of switch timings with self-driven synchronous rectifier MOSFET devices. Very close coupling obviates the disadvantages with slow turn-off which causes cross-conduction and slow turn-on which causes body diode conduction. Very close coupling will drive accurate timing with no cross-conduction and with no delay which would allow body diode conduction.

Referring to FIG. 5 of the drawings, there is shown a side view of a secondary winding. The power secondary windings 7 is implemented using folded-foil approaches to provide integral feet 21, which can be soldered into the main printed circuit board (not shown). The secondary winding is a section of stamped copper that is subsequently folded to give effect to a winding. The foil winding 7 is insulated throughout except at the integral feet 21.

Referring to FIG. 6, there is shown a diagrammatic representation of a flux balance winding 13 pattern for use in the transformer assembly according to the present invention. The flux balance winding 13 is a unitary winding 23 that may be bent along the fold lines, represented by dashed line 25, so that the portion of the unitary winding between the fold lines 25 will lie above the printed circuit board 9, primary winding 5 and secondary windings 7 in use. The remainder of the flux balance winding will lie adjacent to a secondary winding intermediate that secondary winding and the nearest core section. The portion 27 of the flux balance winding within the dashed-line boxed section will be insulated.

The portion 27 of the unitary winding 23 between the fold lines that lies above the printed circuit board 9, primary winding 5 and secondary windings 7 has been omitted from FIGS. 1 and 2 for clarity and it will be understood that this would lie above the other components. Furthermore, it will be understood that other alternative configurations of one or more flux balance windings could be used with the transformer according to the invention to good effect. The example of flux winding shown in FIG. 6 is a particularly effective implementation for a centre-tapped secondary winding.

It will be recognised that minimising leakage inductance between both halves of a centre-tapped winding is important. For assembly simplicity, it is convenient to have each half winding of a centre-tapped secondary winding at one side of the central gate drive and primary winding assembly. This approach can lead to poor coupling between both halves of the secondary winding due to the physical separation between the two halves, resulting in power loss and in "spiking" across power semiconductors, requiring dissipative snubbing and clamping elements. The above technique involves usage of a flux balance winding 13 for reducing leakage inductance between "lumped" (i.e. non-interleaved) secondary windings. The flux balance winding 13 is shown here as outside the power windings, but it is possible for this to be centrally located in the power windings or indeed multiple balance windings can be used to optimise coupling. The flux balance winding 13 may be located intermediate the primary and secondary windings or alternatively may be enmeshed in the secondary windings or outside the secondary subject to suitable coupling being achieved.

Referring to FIG. 7 of the drawings, there is shown a cross-sectional view of a PCB 9 similar to that shown in FIGS. 3 and 4 except without a channel 16 formed therein. The PCB 9 shows the gate drive windings 31, 33 otherwise referred to as gate drive turns. These gate drive windings 31, 33 are connected to gates (not shown) elsewhere on a main PCB (not shown) through the connections on the fingers 15. The gate drive windings may have a different form and are only shown as an illustration of the use of the PCB to house gate drive windings.

Figure 8:
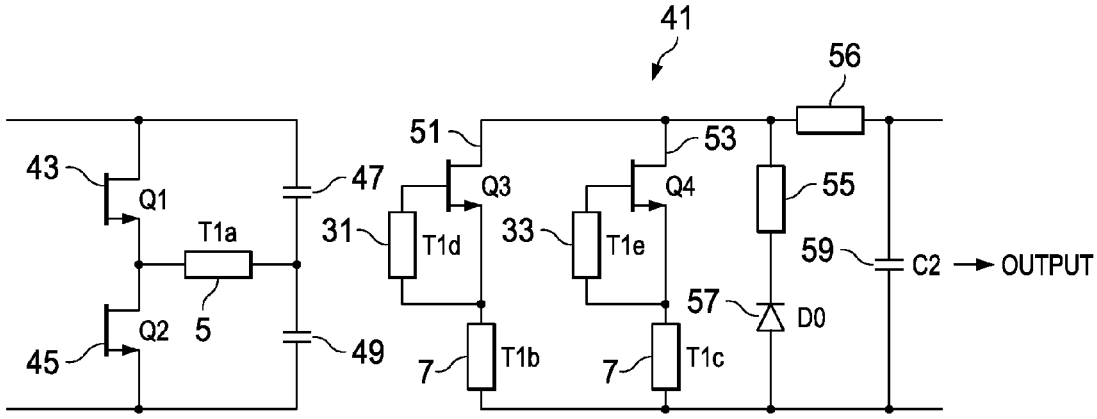
FIG. 8 is a circuit schematic of a transformer according to the present invention implemented in a power converter showing the gate components.

Referring to FIG. 8 there is shown a circuit schematic of a power converter incorporating the transformer according to the present invention. The power converter, indicated generally by the reference numeral 41, comprises a pair of primary side switches 43, 45, a pair of primary side capacitors 47, 49, a primary winding 5, a centre-tapped secondary winding comprising a pair of winding halves 7, a pair of MOSFETs 51, 53, each of which has a gate drive turn 31, 33 associated therewith, a tapped output inductor having sections 55, 56, an output diode 57 and an output capacitor 59.

Figure 9:
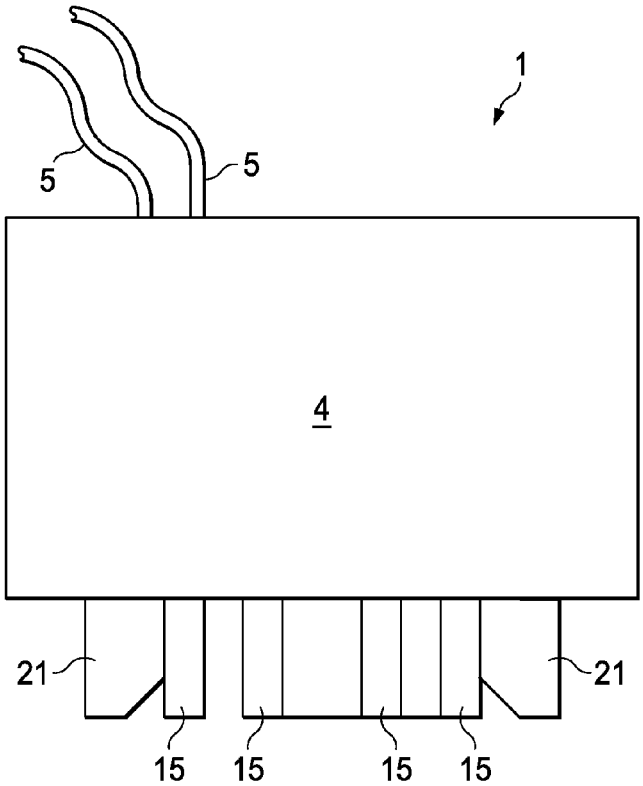
FIG. 9 is a side elevation view of the transformer assembly shown in FIGS. 1 and 2.
Figure 10:
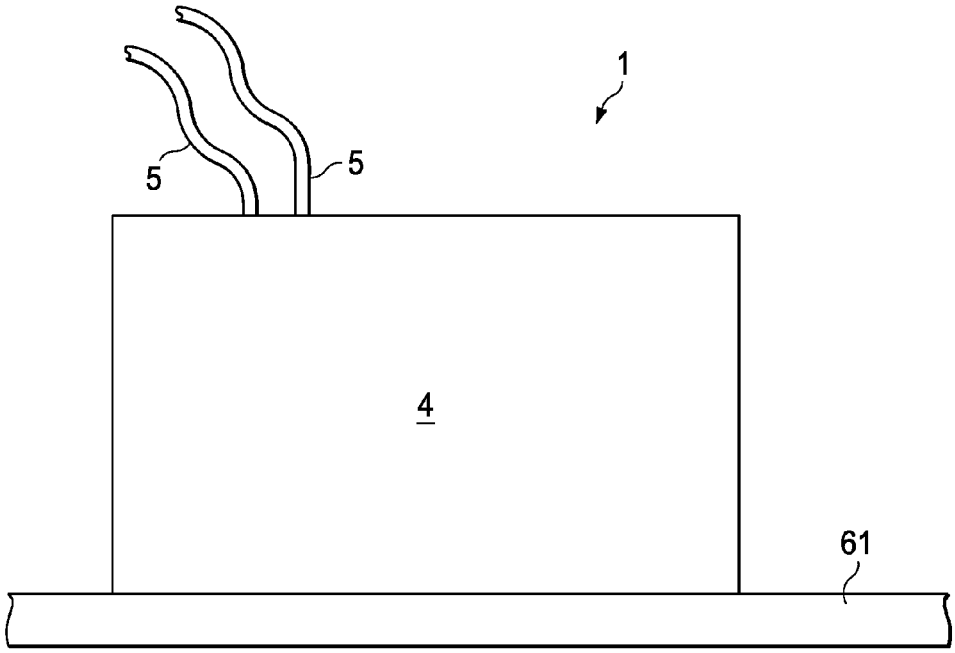
FIG. 10 is a side elevation view of the transformer assembly of FIG. 9 shown mounted on a mother PCB.

Referring to FIG. 9 there is shown a side elevation view of the transformer assembly 1 according to the invention. The transformer assembly has primary winding wire 5 exiting from the top of the transformer. The transformer has a plurality of protruding fingers 15 and integral feet 21 that may be used to mount the transformer onto a PCB. Referring to FIG. 10, there is shown a side view of the transformer assembly mounted on a mother PCB by its integral feet and its fingers.

Figure 11:
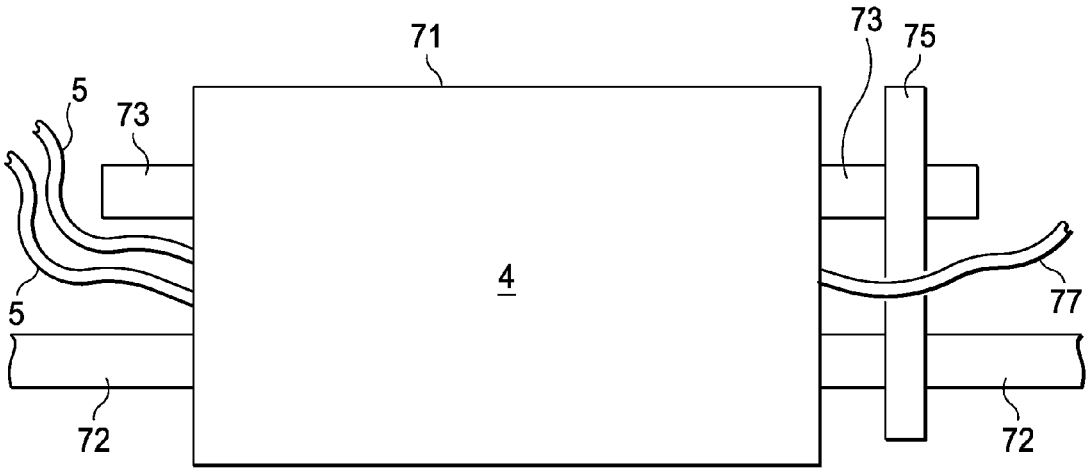
FIG. 11 is a side elevation view of the transformer assembly according to the present invention mounted on a mother PCB using an alternative mounting arrangement.

Referring to FIG. 11, there is shown a side view of an alternative mounting arrangement. The transformer assembly 71 is mounted on its side and laid flat on the main mother PCB 72. In this way, the gate drive windings may be implemented in the main PCB 72 and the primary winding 5 may be wound on that or another PCB section 73 before the core sections 4 are joined together about the windings. A local printed circuit board 73 is provided as part of the transformer assembly and a pin 75 is provided connected to both the local PCB 73 and the main PCB 72 to secure the local PCB 73 and hence the transformer assembly 71 in position relative the main PCB 72. A wire 77 from the secondary winding is led off from the transformer at the end of the transformer opposite the end from which the primary winding 5 leads exit the transformer 71. This construction is useful for low profile implementations.

In the embodiment shown, the transformer mounting in a main printed circuit board (not shown) is secured by the integral feet 21 integrally formed from the outer secondary coils 7 and/or by the fingers 15 formed integrally with the printed circuit board 9. The protrusions may alternatively be provided by tabs on other printed circuit board/boards implementing the required windings. As a further refinement, the magnetic E-core sections 4 may be notched to facilitate the ingress and egress of wire connections (not shown).

It will be appreciated that variations of the implementation described above are feasible, and several of these are envisaged by the applicant. In particular, printed circuit board techniques may be used to implement some or all of the windings mentioned. In certain implementations, the primary windings may be implemented in PCB as may the secondary windings. Furthermore, the shields can be implemented in PCB if desired. These implementations using printed circuit board techniques typically will have buried vias in order to achieve the creepage and clearance requirements needed as the buried vias will provide additional insulation. It will be understood that any combination of the primary windings, secondary windings, gate drive windings, bias windings and balancing windings can be implemented in PCB.

The order of the windings may also be altered in response to circuit requirements. For example, it is envisaged that in certain embodiments, a dual primary winding with one or more secondary windings sandwiched between the dual primary winding halves may be preferred. Similarly, other configurations may be desirable and the present invention could be implemented in those configurations also. In such configurations, the primary may be wound on another substrate such as the secondary winding or a shield. Furthermore, gaps between the windings may be provided for controlled leakage inductance values. Throughout the specification, the secondary winding has been shown as a centre tapped secondary winding. However, it will be understood that other implementations of secondary winding could be provided. For example, a single, unitary secondary winding could be provided rather than a secondary winding having two halves.

In the specification transformers are described as being ideally highly efficient (99% efficient), have low leakage inductance (typically, 1% leakage inductance or a controlled value) between the primary and the secondary windings, possess high voltage isolation corresponding at least to safety agency requirements, are compact with an acceptable form factor (which is dependent on the transformer application), provide quiet audio noise performance (consistent with an audio noise level of less than 30 dBA) even with signals having an audio frequency component, provide excellent coupling (sufficient to contain spiking but dependent on the application and drive waveform transition times) between the two sides of a centre tapped winding and finally allow for simple provision of multiple wire requirements for gate drives, auxiliary supplies (as is achieved in a PCB implementation) and the like.

The present invention further relates to an improved process for manufacturing a transformer assembly. The process comprises the steps of taking a PCB having drive windings as one or more layers therein and placing a coiled primary winding on the PCB. A centre-tapped secondary winding is placed either side of the PCB and a flux balance winding is placed adjacent to the secondary winding. A pair of core sections 4 are then joined together thereby encapsulating the windings and the PCB.

Various alternatives are envisaged. For example, the secondary may be a unitary winding and therefore the order of placement will vary. Similarly, the primary winding may have several components and these will be placed in order accordingly. Various shields and flux balance windings may or may not be put in place depending on the circuit requirements. Furthermore, in the embodiment shown in FIG. 11, the lower part of the core is mounted to the board from below and the legs pass through the PCB mother board. The PCB mother board has gate drive windings thereon. It may also have other windings thereon. Various PCB layers, windings and shields may then be placed on top of the core section protruding up through the board, again depending on the specific configuration of transformer until all are in place and the other core section is placed down on top of the first core section and they are sealed together.

A significant advantage of the process according to the invention is the manner in which the primary winding is a wound. The wound wire may be placed onto a PCB and wound in place or if a channel 16 is provided (such as that shown in FIGS. 3 and 4) the wire may be wound before being placed onto the PCB 9 which can be advantageous. Very significantly, due to the orientation of the wire windings, both of the leads (terminations) of the primary winding are accessible from the periphery of the winding and hence do not have to travel across the other windings which has significant manufacturing and performance advantages. This is achieved by ensuring that the wire is wound in two separate sections, the first of which is wound inwardly with the wire windings decreasing in diameter followed by an cross interconnection to the second section in which the wire is wound outwardly with the wire windings increasing in diameter. Each section of wire is would in the same orientation as the other section e.g. clockwise. In this way, both of the leads or terminations of the primary winding will be at the periphery of the winding.

In this specification the terms "comprise, comprises, comprised and comprising" and the terms "include, includes, included and including" are all deemed totally interchangeable and should be afforded the widest possible interpretation.

The invention is in no way limited to the embodiment hereinbefore described but may be varied in both construction and detail within the scope of the specification.

The invention claimed is:

1. A transformer assembly comprising a magnetic core, a primary winding and a secondary winding, wherein the primary winding further comprises a spiral winding of insulated wire, the spiral winding having a pair of connected spiral sections, the first spiral section winding inwardly and gradually decreasing in diameter to a connection branch with the second spiral section and the second spiral section winding outwardly and gradually increasing in diameter from the connection branch so that both ends of the winding are accessible at the periphery of the winding, in which there is provided a substrate upon which the primary winding is wound and each spiral section is wound on one side of the substrate, the substrate being substantially horseshoe shaped with an open channel for through passage of the primary winding.

2. A transformer assembly as claimed in claim 1 in which the wire is wound flat against the substrate.

3. A transformer assembly as claimed in claim 1 in which the secondary winding is implemented using folded foil techniques.

4. A transformer assembly as claimed in claim 1 in which magnetic core further comprises a pair of E-cores mounted face to face with the arms of the E-cores opposing each other.

5. A transformer assembly as claimed in claim 1 in which the magnetic core further comprises an E-core and a planar core with the arms of the E-core facing the planar core.

6. A transformer assembly comprising a magnetic core, a primary winding and a secondary winding, wherein the primary winding further comprises a spiral winding of insulated wire, the spiral winding having a pair of connected spiral sections, the first spiral section winding inwardly and gradually decreasing in diameter to a connection branch with the second spiral section and the second spiral section winding outwardly and gradually increasing in diameter from the connection branch so that both ends of the winding are accessible at the periphery of the winding, in which there is provided a printed circuit board upon which the primary winding is wound and each spiral section is wound on one side of the printed circuit board, in which the transformer further comprises a gate drive turn implemented as a layer of a printed circuit board.

7. A transformer assembly as claimed in claim 6 in which the outer faces of the printed circuit board are implemented as shields.

8. A transformer assembly comprising a magnetic core, a primary winding and a secondary winding, wherein the primary winding further comprises a spiral winding of insulated wire, the spiral winding having a pair of connected spiral sections, the first spiral section winding inwardly and gradually decreasing in diameter to a connection branch with the second spiral section and the second spiral section winding outwardly and gradually increasing in diameter from the connection branch so that both ends of the winding are accessible at the periphery of the winding, in which there is provided a shield interposed between the primary winding and the secondary winding, the shield being a unitary shield substantially H-shaped having a cross bar and two pairs of legs projecting outwardly from the cross bar, the cross bar of the shield being positioned above the transformer adjacent the substrate and a pair of the legs of the shield protruding downwardly between the primary winding and the secondary winding on either side of the substrate.

9. A transformer assembly as claimed in claim 8 in which the shield interposed between the primary winding and the secondary winding is connected to an outer face shield of a printed circuit board.

10. A transformer assembly comprising a magnetic core, a primary winding and a secondary winding, wherein the primary winding further comprises a spiral winding of insulated wire, the spiral winding having a pair of connected spiral sections, the first spiral section winding inwardly and gradually decreasing in diameter to a connection branch with the second spiral section and the second spiral section winding outwardly and gradually increasing in diameter from the connection branch so that both ends of the winding are accessible at the periphery of the winding in which there is provided a flux balance winding located intermediate the secondary winding and an adjacent magnetic core section.

11. A transformer assembly as claimed in claim 10 in which the flux balance winding is located intermediate the secondary winding and the primary winding.

12. A transformer assembly comprising a magnetic core, a primary winding, a centre tapped secondary winding having a pair of physically separated halves, the transformer further comprising a flux balance winding to reduce effective leakage inductance between the two halves of the centre tapped secondary.

13. A transformer assembly as claimed in claim 12 in which the flux balance winding is located intermediate the secondary winding and an adjacent magnetic core section.

14. A transformer assembly as claimed in claim 12 in which the flux balance winding is a unitary winding extending across the PCB and in which the flux balance winding is insulated around the area of the winding adjacent the PCB.

15. A transformer assembly as claimed in claim 12 in which there are provided a pair of separate flux balance windings, one of which is associated with one half of the centre tapped secondary winding and the other of which is associated with the other half of the centre tapped secondary winding.

* * * * *